US005882001A

United States Patent [19]

Reinbold

[11] Patent Number: 5,882,001

[45] Date of Patent: Mar. 16, 1999

[54] MODULAR FENCE STRUCTURE

[76] Inventor: James F. Reinbold, 1425 Jami Dr., Norman, Okla. 73701

[21] Appl. No.: 904,051

[22] Filed: Jul. 31, 1997

[51] Int. Cl.[6] ..... E04H 17/16

[52] U.S. Cl. ..... 256/22; 256/65; 256/68

[58] Field of Search ..... 256/59, 65, 21, 256/22, 24, 68, 70, 56, 20

[56] References Cited

U.S. PATENT DOCUMENTS

| | | | |
|---|---|---|---|
| 210,826 | 12/1878 | Van Dorn | 256/70 |
| 3,315,943 | 4/1967 | Van Den Broek | 256/22 |
| 3,815,876 | 6/1974 | Saez | 256/59 X |
| 3,822,053 | 7/1974 | Daily | 256/21 X |
| 3,955,799 | 5/1976 | Lauzier | 256/21 |
| 3,975,000 | 8/1976 | Sado | 256/59 |
| 4,883,256 | 11/1989 | Hebda | 256/22 |
| 4,962,914 | 10/1990 | Taylor | 256/72 |
| 5,150,885 | 9/1992 | Leone | 256/22 |
| 5,238,321 | 8/1993 | Jarjoura | 403/172 |
| 5,454,548 | 10/1995 | Moore | 256/22 |
| 5,547,169 | 8/1996 | Russell | 256/65 X |
| 5,581,868 | 12/1996 | Bisch | 256/22 X |
| 5,660,378 | 8/1997 | Schall | 256/65 |

FOREIGN PATENT DOCUMENTS

| | | | |
|---|---|---|---|
| 402041 | 5/1966 | Switzerland | 256/59 |
| 1505 | of 1886 | United Kingdom | 256/70 |
| 2070664 | 9/1981 | United Kingdom | 256/59 |

*Primary Examiner*—Harry C. Kim
*Attorney, Agent, or Firm*—Robert K. Rhea

[57] ABSTRACT

A picket fence is formed by a plurality of posts having vertically spaced ribs on confronting surfaces for supporting the respective end portion of inverted U-shaped rails. The rails are provided with a plurality of longitudinally equally spaced vertically aligned apertures with each aperture having a tab portion of the U-shaped rail bight portion projecting into the aperture. A like plurality of pickets are cooperatively received by the respective aligned apertures, with each picket having a pair of transverse longitudinally spaced slots in its wall cooperatively nesting a respective tab projecting into each slot. An inverted L-shaped spring steel clip enters the respective aperture on that side of the post opposite its slot to engage upper and lower surfaces of the bight portion of the respective rail adjacent the aperture, and lock the respective picket against movement relative to the rails.

5 Claims, 1 Drawing Sheet

54
53
57
52
56

52
16
46
50
19
53
57
20
48
16
46
19
48

20
19
48
16
40
46
48
5
5
52
50
57
42
42
43
56
43

2
19
10
24
20
14
16
6
6
19
24
24
22
12
14
22
28
26
38
34
36
18
24
22
32
30
24

MODULAR FENCE STRUCTURE

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to modular fencing of rail and picket type equally easily assembled at the factory or job site.

A variety of metal picket fences may be found in use. Generally these picket fences have been formed from rods or tubes of metal which are welded to upper and lower rails to form panels. The panels being fastened to posts or are welded if metal posts are used or bolted or screwed fittings are employed where posts of other material is used and the panel installed between adjacent upright posts. These types of fence are sturdy but have a number of problems such as, the welded areas are prone to rusting even when painted, and if galvanized components are used the welding destroys the coating at the weld area leading to rusting. Metal picket fences are usually assembled and joined together at the job site and as a general rule have required considerable skill and time on the part of the workman.

This invention fills a need for modular picket fence components which may be formed from metal and easily and conveniently assembled on the job site by professionals or a homeowner.

BRIEF SUMMARY OF THE INVENTION

One unit or panel of this fencing system comprises a pair of vertical posts positioned at suitable distance and set in appropriate footing material with horizontal rails, upper and lower, extending between and secured to the posts. The rails each contain vertical apertures through which pickets are inserted. Each picket receiving aperture is characterized by a protruding tab which positions each picket at a predetermined elevation with respect to its supporting rails by intruding into a prepunched mating slot in the wall of the picket. Ribs and clips secure the horizontal rails to the posts and the pickets to the rails. A variety of finials or decorative post and picket parts are formed on or provided to attach to the upper limit of the pickets and posts.

The principal object of the invention is to provide a decorative and functional enclosure for any physical area for a wide range of purposes formed from modular stock parts permitting a complete customized fencing section which may be erected at the installation site, preferably from prefabricated metallic material, creating a fence of unlimited life expectancy, in normal usage.

DESCRIPTION OF THE PREFERRED EMBODIMENTS

Figures 1, 2, 3, 4, 5, 6:
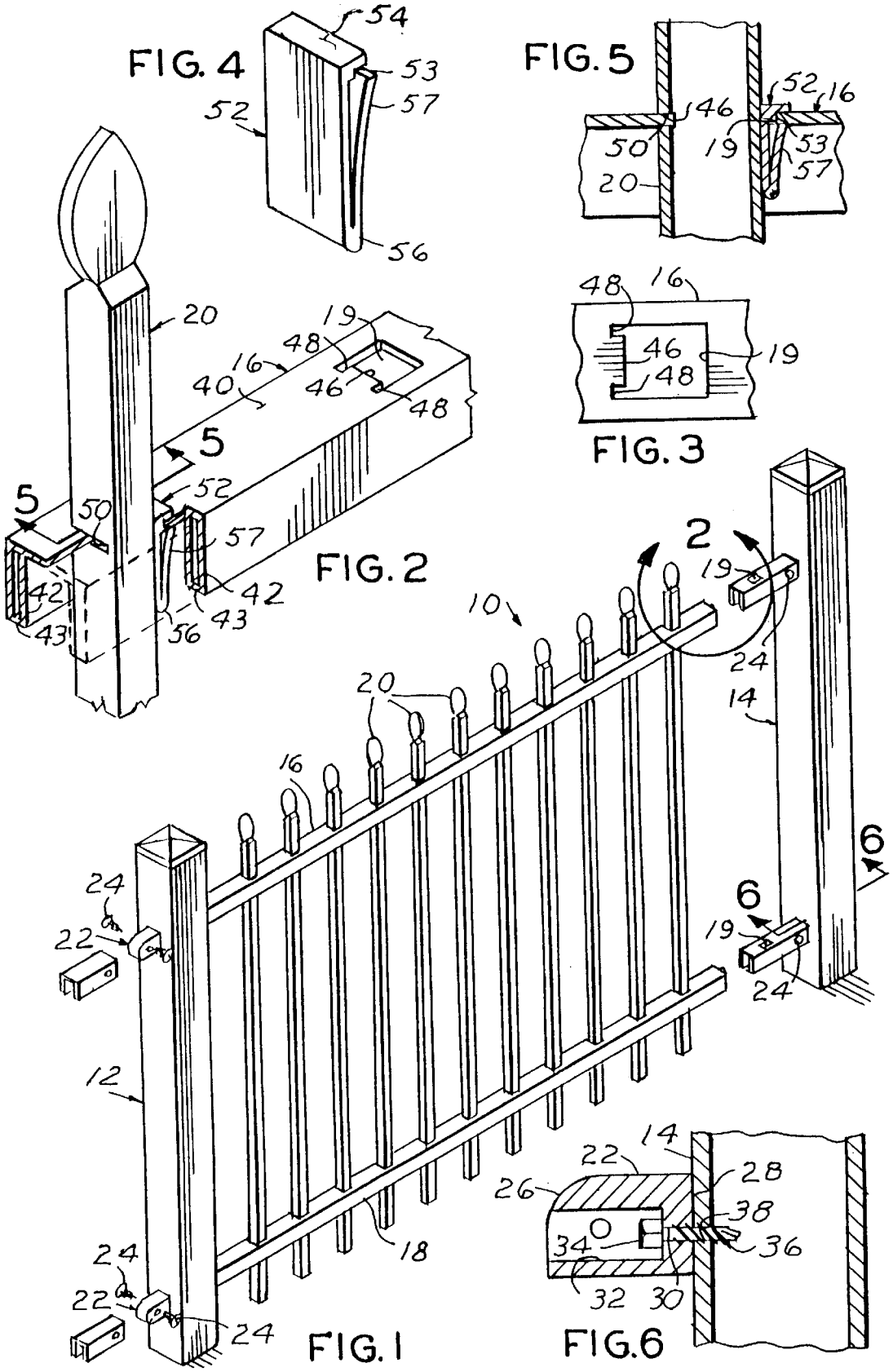
FIG. 1 is a fragmentary isometric view of one section of the fence with pickets removed for clarity.
FIG. 2 is an fragmentary exploded perspective view of the area enclosed by the arrows 2.
FIG. 3 is a fragmentary top view of a rail aperture.
FIG. 4 is an isometric view of a picket locking clip.
FIG. 5 is a fragmentary vertical cross-sectional view taken substantially along the line 5—5 of FIG. 2; and, FIG. 6 is a fragmentary vertical cross-sectional view taken substantially along the line 6—6 of FIG. 1 with the rail removed for clarity.

Like characters of reference designate like parts in those figures of the drawings in which they occur.

In the drawings:

The reference numeral 10 indicates one panel of a fence interposed between and connected with a pair of posts 12 and 14 usually spaced apart approximately 2½M (8 ft.). The fence panel 10 comprises upper and lower, inverted U-shape in transverse section, horizontal channels or rails 16 and 18, respectivelly, having a plurality of longitudinally, equally spaced, vertically aligned non-circular apertures 19 in the bight portion thereof, for receiving a plurality of non-circular, preferably four-sided pickets 20. The vertical dimensions of the panel and posts are a matter of choice and for residential fencing is usually approximately 2M (6 ft. 6 in.). In the example shown, the posts 12 and 14 are square tubular but obviously may be of other cross-sectional configuration as desired. The confronting surfaces of the posts 12 and 14 are each provided with a pair of rectangular vertically spaced rib means 22, for supporting the end portions of the rails 16 and 18. Each U-shaped end portion of the rail 18 straddles the respective lower rib 22 and the rail legs and rib are transversely line-drilled in cooperative relation for receiving fasteners 24 securing the rail to the rib. The end surface of the ribs opposite the post 14 is arcuately curved downwardly, as at 26, which permits the opposite end of the rail to be inclined downwardly relative to the horizontal in accordance with terrain traversed by the fence.

The rib 22 is longitudinally drilled from its arcuate surface 26 through its opposite orthogonal end surface 28, as at 30, and counterbored, as at 32, for receiving a wrench socket, not shown, and the head 34 of a self-tapping screw 36 entering a pilot bore 38 in the wall of the post 14.

In the event wood posts are used for the fence the ribs 22 may be formed with a well known lag screw threaded shaft, not shown, for attachment to the wood posts.

The rails 16 and 18 are identical and only one is described in detail in the interest of brevity. The inverted U-shape rail 16 having a planar bight portion 40 (Fig.2) and depending parallel legs 42. Each of the legs are preferably box-like in transverse section formed by inner and outer side walls and joined by a bottom wall 43 to add rigidity to the rail in the event it is formed from low mass material, such as aluminum.

One wall edge 46, defining the apertures 19, is provided with a recess 48 (FIG.3) at its ends adjacent the wall edges forming adjacent opposite sides of the apertures 19 to form a tab 46 projecting toward the opposite side of the aperture 19 for entering a cooperative tab receiving slot 50 transversely formed in an adjacent wall surface of each picket. The picket wall slots 50 are vertically spaced equidistant with respect to the spacing between the bight 40 of the respective rails 16 and 18 which prevents movement of the pickets relative to the rails after being anchored or locked in the rails as will now be explained.

A spring steel picket lock clip means 52, substantially inverted L-shape in side elevation, is dimensioned to enter the rail aperture 19 adjacent the outer surface of the respective picket opposite its tab locating slot 50 to lock the respective picket to the respective rail 16 and/or 18. The clip foot portion 54 has a rabbited edge 53 which nests the adjacent edge portion of the rail bight 40. The clip leg portion 56 enters the spacing between the respective picket 20 and the adjacent wall surface defining an aperture 19. The clip leg 56 is divided or split downwardly from the rabitted edge 53, to a point near its depending limit to form a V-shape. One leg of the V-shape, comprises a rectangular locking flap or panel 57 normally bowed, at its upper end portion, out of the plane of the clip leg in a direction opposite the picket to underlie, at its upper end edge surface, the adjacent bottom surface of the rail bight portion 40. The panel 57 is biased inwardly toward the plane of the clip leg when the clip 52 is manually forced into the spacing between the respective picket 20 and the adjacent edge defining the aperture 19. When the clip is fully inserted into the aperture 19, the flap 57 springs outwardly and underlies the bottom surface of the rail bight portion 40 which locks the picket 20 to the rail in combination with the locating tab 46 in the respective picket slot 50.

Obviously the invention is susceptible to changes or alterations without defeating its practicability. Therefore, I do not wish to be confined to the preferred embodiments shown in the drawings and described herein.

I claim:

1. A picket fence panel assembly, comprising:

upper and lower vertically spaced inverted U-shape rails each having a bight portion and a plurality of longitudinally spaced non-circular apertures therethrough in substantial vertical alignment, each aperture being characterized by a tab projecting toward an opposite limit of the aperture;

a like plurality of vertically disposed tubular pickets cooperatively received by and extending vertically through the aligned apertures, each said picket having vertically spaced wall slots cooperatively nesting said tabs; and, a picket locking fastener interposed in the aperture between each said picket opposite said tab and the opposite limit of the aperture diametrically opposite the tab, said fastener having end surfaces respectively abutting adjacent opposite surfaces of said rail bight portion.

2. The fence panel assembly according to claim 1 and further including:

a post at respective ends of said panel assembly; and, a pair of fence rail end portion supporting ribs secured to confronting surfaces of each said post in cooperative vertically spaced relation.

3. A picket fence panel assembly, comprising:

upper and lower vertically spaced inverted U-shape rails each having a bight portion and a plurality of longitudinally spaced non-circular apertures therethrough in substantial vertical alignment, each aperture being characterized by a rail tab projecting toward an opposite limit of the aperture;

a post at respective ends of said panel assembly;

rib means on each said Dost for supporting respective end portions of said rails;

a like plurality of vertically disposed tubular pickets cooperatively received by and extending vertically through the aligned apertures, each said picket having vertically spaced wall slots cooperatively nesting said tabs; and, picket locking means interposed in one rail aperture between the picket outer surface opposite said tab and the opposite limit of the aperture diametrically opposite the tab and cooperating with said tab for precluding movement of said pickets with respect to said rail, said picket locking means including:

an inverted L-shaped member having a foot portion overlying the rail bight portion adjacent said one aperture and having a leg substantially defining a V-shape and having one leg of the V-shape underlying the rail bight portion in opposition to said foot portion.

4. The picket fence panel assembly according to claim 3 in which said L-shaped member is formed from spring steel material.

5. The picket fence panel assembly according to claim 3 in which said rib means comprises:

a rectangular member having an orthogonal end surface abutting said post and having an opposite arcuate end surface.

* * * * *